US008676087B2

(12) United States Patent
Itabashi

(10) Patent No.: US 8,676,087 B2
(45) Date of Patent: Mar. 18, 2014

(54) IMAGE FORMING DEVICE HAVING CHARGING WIRE CLEANING MECHANISM

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 71 days.

(21) Appl. No.: 13/165,528

(22) Filed: Jun. 21, 2011

(65) Prior Publication Data

US 2012/0002999 A1 Jan. 5, 2012

(30) Foreign Application Priority Data

Jun. 30, 2010 (JP) ..... 2010-148558

(51) Int. Cl.
*G03G 15/02* (2006.01)

(52) U.S. Cl.
USPC ..... 399/115; 399/123

(58) Field of Classification Search
USPC ..... 399/100, 115, 123, 175
See application file for complete search history.

(56) References Cited

U.S. PATENT DOCUMENTS

| | | | | |
|---|---|---|---|---|
| 4,811,050 | A * | 3/1989 | Tanjo et al. | 399/100 |
| 6,920,297 | B2 * | 7/2005 | Itabashi | 399/100 |
| 7,127,190 | B2 * | 10/2006 | Gumbe | 399/100 |
| 2004/0062565 | A1 | 4/2004 | Itabashi | |
| 2006/0140664 | A1 | 6/2006 | Takami | |
| 2007/0036577 | A1 | 2/2007 | Okabe et al. | |
| 2007/0077087 | A1 * | 4/2007 | Okabe et al. | 399/111 |
| 2010/0166456 | A1 * | 7/2010 | Shimizu et al. | 399/114 |

FOREIGN PATENT DOCUMENTS

| | | | |
|---|---|---|---|
| CN | 1794112 | A | 6/2006 |
| JP | H04-134372 | A | 5/1992 |
| JP | 2004-118092 | A | 4/2004 |
| JP | 2006-184316 | A | 7/2006 |
| JP | 2007-072420 | A | 3/2007 |
| JP | 2007-233281 | A | 9/2007 |

OTHER PUBLICATIONS

State Intellectual Property Office of the People'S Republic of China, Notification of First Office Action for Chinese Patent Application No. 201110192421.5 (counterpart to above-captioned patent application), mailed Nov. 1, 2013.

* cited by examiner

*Primary Examiner* — Clayton E LaBalle
*Assistant Examiner* — Victor Verbitsky
(74) *Attorney, Agent, or Firm* — Baker Botts L.L.P.

(57) ABSTRACT

An image forming device including an accommodating member, a moving section, a driving section, a transmitting section, and first and second switching sections. The accommodating member is movable between an accommodating position and a pulled-out position. A charger includes a charging wire and a wire cleaner movable therealong. The moving section is configured to move the wire cleaner. The driving section is configured to generate a drive force to move the moving section. The transmitting section is movable to one of a first path on which the transmitting section is drivingly connected to the driving section and a second path on which the transmitting section is disconnected from the driving section. The transmitting section is configured to transmit the drive force from the driving section to the moving section when the transmitting section is moved to the first path. The first switching section is configured to switch a position of the transmitting section from the second path to the first path. The second switching section is configured to switch a position of the transmitting section from the first path to the second path.

14 Claims, 14 Drawing Sheets

IMAGE FORMING DEVICE HAVING CHARGING WIRE CLEANING MECHANISM

CROSS REFERENCE TO RELATED APPLICATION

This application claims priority from Japanese Patent Application No. 2010-148558 filed Jun. 30, 2010. The entire content of the priority application is incorporated herein by reference.

TECHNICAL FIELD

The present invention relates to an image forming device such as a laser printer.

BACKGROUND

A conventional image forming device such as a laser printer includes a main casing, and within the main casing, a drum unit is detachably mounted. The drum unit includes a photosensitive drum, a developing cartridge retaining a developing roller, and a charger for uniformly charging a surface of the photosensitive drum. A scorotron charger having a charging wire and a grid electrode has been widely used as the charger.

While using the image forming device, dust such as paper dust are deposited on the charging wire. If dust is deposited on the charging wire, charging performance of the wire to charge the surface of the photosensitive drum is degraded. In order to prevent dust from being deposited on the charging wire, the charger includes a wire cleaner for cleaning the charging wire. The wire cleaner is moved along the charging wire, so that the charging wire can be cleaned.

SUMMARY

In order to maintain satisfactory charging performance of a charging wire, regular cleaning to the charging wire is required. However, for a user, it is rather cumbersome to regularly clean the charging wire. Then, a mechanism for moving a wire cleaner in interlocking relation to the detaching and attaching movement of a drum unit with respect to a main casing is demanding.

However, when cleaning the charging wire, the wire cleaner is required to be moved throughout an overall length of the charging wire. Unless the wire cleaner is moved throughout the overall length of the charging wire, dust collected by the wire cleaner may remain on the charging wire. That is, if the wire cleaner is not moved from one end of the charging wire to another end thereof, a portion of the charging wire is cleaned but remaining portion thereof remains uncleaned. This may cause non-uniform charge on the surface of the photosensitive drum. Further, a portion of the charging wire on which dust has been deposited may cause abnormal electrical discharge.

In view of the foregoing, it is an object of the present invention to provide an image forming device capable of saving time and effort of a user on cleaning a charging wire, and capable of uniformly charging a surface of a photosensitive drum.

In order to attain the above and other objects, the present invention provides an image forming device including: a main casing; a photosensitive member; a charger; an accommodating member; a moving section; a driving section; a transmitting section; a first switching section; and a second switching section. The photosensitive member has an axis defining an axial direction and a surface including an image forming region on which an electrostatic latent image is formed. The image forming region has a width in the axial direction. The charger includes: a charging wire extending in the axial direction and configured to charge the surface of the photosensitive member; and a wire cleaner movable along the charging wire while being in sliding contact with the charging wire. The accommodating member is configured to accommodate therein the photosensitive member and the charger, and movable in a moving direction between an accommodating position where the accommodating member is accommodated in the main casing and a pulled-out position where the accommodating member is pulled outward of the main casing. The moving section is accommodated in the accommodating member and configured to move the wire cleaner. The driving section extends in the main casing and is configured to generate a drive force to move the moving section. The transmitting section is accommodated in the accommodating member and movable selectively to one of a first path on which the transmitting section is connected to the driving section and a second path on which the transmitting section is disconnected from the driving section. The transmitting section is configured to transmit the drive force from the driving section to the moving section when the transmitting section is moved to the first path. The first switching section is disposed at the main casing and located at a pulled-out position side relative to the driving section. The first switching section is configured to switch a position of the transmitting section from the second path to the first path. The second switching section is disposed at the main casing and located at an accommodating position side relative to the driving section. The second switching section is configured to switch a position of the transmitting section from the first path to the second path.

DETAILED DESCRIPTION

1. General Structure of Color Printer

Figure 1:
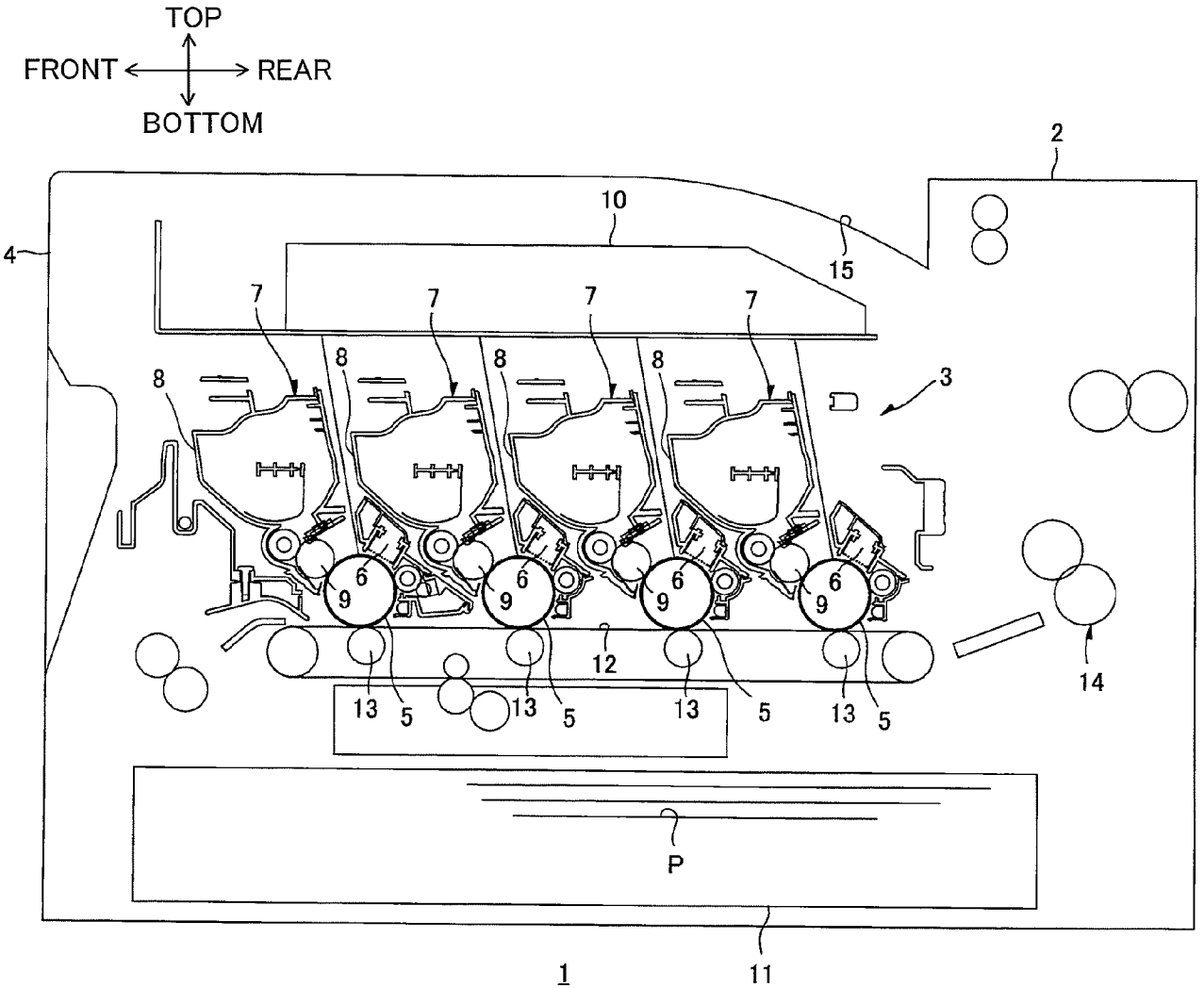
FIG. 1 is a schematic cross-sectional view of a color printer according to one embodiment of the present invention.

A tandem type color printer as an image forming device according to one embodiment of the present invention will be described while referring to FIG. 1. The color printer 1 includes a main casing 2 constituting a main body. Within the main casing 2, a drum unit 3, an exposure unit 10, a sheet supply cassette 11, and a fixing unit 14 are provided.

Throughout the specification, the terms "above", "below", "right", "left", "front", "rear" and the like will be used throughout the description assuming that the color printer 1 is disposed in an orientation in which it is intended to be used. In use, the color printer 1 is disposed as shown in FIG. 1. More specifically, in FIG. 1, a left side and a right side are a front side and a rear side, respectively.

The main casing 2 has a front cover 4 positioned at a front side thereof and a discharge tray 15 positioned at a top surface thereof. The front cover 4 is pivotally movable between an open position and a closed position. When the front cover 4 is in the open position, the drum unit 3 is horizontally movable in a frontward/rearward direction. More specifically, the drum unit 3 is movable between an accommodating position at which the drum unit 3 is accommodated in the main casing 2 and a pulled-out position at which the drum unit 3 is pulled out of the main casing 2.

The drum unit 3 includes a plurality of (four) photosensitive drums 5, a plurality of (four) chargers 6, and a plurality of (four) developing cartridges 7. Each of the photosensitive drums 5 has an axis extending in a leftward/rightward direction, and is rotatably supported to the drum unit 3. The four photosensitive drums 5 are provided for four colors of black, yellow, magenta, and cyan, respectively. The photosensitive drums 5 are juxtaposed with each other in the frontward/rearward direction in order of black, yellow, magenta, and cyan from the front side of the color printer 1, and spaced apart from each other at a predetermined distance.

The four chargers 6 are provided in one-on-one correspondence with respect to the four photosensitive drums 5. Each of the chargers 6 is disposed diagonally above and rearward of the corresponding photosensitive drum 5. The charger 6 is a scorotron charger provided with a charging wire 37 (FIG. 5) for charging a surface of the corresponding photosensitive drum 5.

The four developing cartridges 7 are provided in one-on-one correspondence with respect to the four photosensitive drums 5. Each of the developing cartridges 7 is detachably mounted in the drum unit 3, and includes a cartridge frame 8 and a developing roller 9 accommodated in the cartridge frame 8.

The exposure unit 10 is disposed above the drum unit 3. The exposure unit 10 is adapted to project a plurality of (four) laser beams corresponding to the four colors used by the color printer 1.

After surfaces of the photosensitive drums 5 are uniformly charged by the chargers 6 in association with rotations of the photosensitive drums 5, the surfaces are selectively exposed to the laser beams emitted from the exposure unit 10. With this exposure, electrical charge is selectively removed from the surfaces of the photosensitive drums 5. Thus, electrostatic latent images are formed on the surfaces of the photosensitive drums 5. When the electrostatic latent images confront the developing rollers 9, toner is supplied to the electrostatic latent images by the developing rollers 9. Hence, toner images are formed on the surfaces of the photosensitive drums 5.

Incidentally, instead of the exposure unit 10, four LED arrays can be provided in one-on-one correspondence with respect to the four photosensitive drums 5.

The sheet supply cassette 11 accommodating a sheet P therein is disposed at a lower portion of the main casing 2. The sheet P accommodated in the sheet supply cassette 11 is fed by various rollers toward a conveying belt 12. The conveying belt 12 is disposed such that a top portion of the conveying belt 12 confronts the four photosensitive drums 5 from below. A plurality of (four) transfer rollers 13 are provided at positions confronting the corresponding photosensitive drums 5, with the top portion of the conveying belt 12 interposed therebetween. The sheet P conveyed onto the conveying belt 12 passes sequentially through positions between the photosensitive drums 5 and the conveying belt 12 as the conveying belt 12 circulates. The toner images formed on the surfaces of the photosensitive drums 5 are transferred onto the sheet P when the toner images confront the sheet P.

The fixing unit 14 is positioned downstream of the conveying belt 12 in a sheet feeding direction of the sheet P. The sheet P onto which the toner images are transferred is conveyed to the fixing unit 14. In the fixing unit 14, the toner images are fixed to the sheet P by heat and pressure. The sheet P to which the toner images are fixed is discharged to the discharge tray 15 by various rollers.

2. Drum Unit

Figure 2:
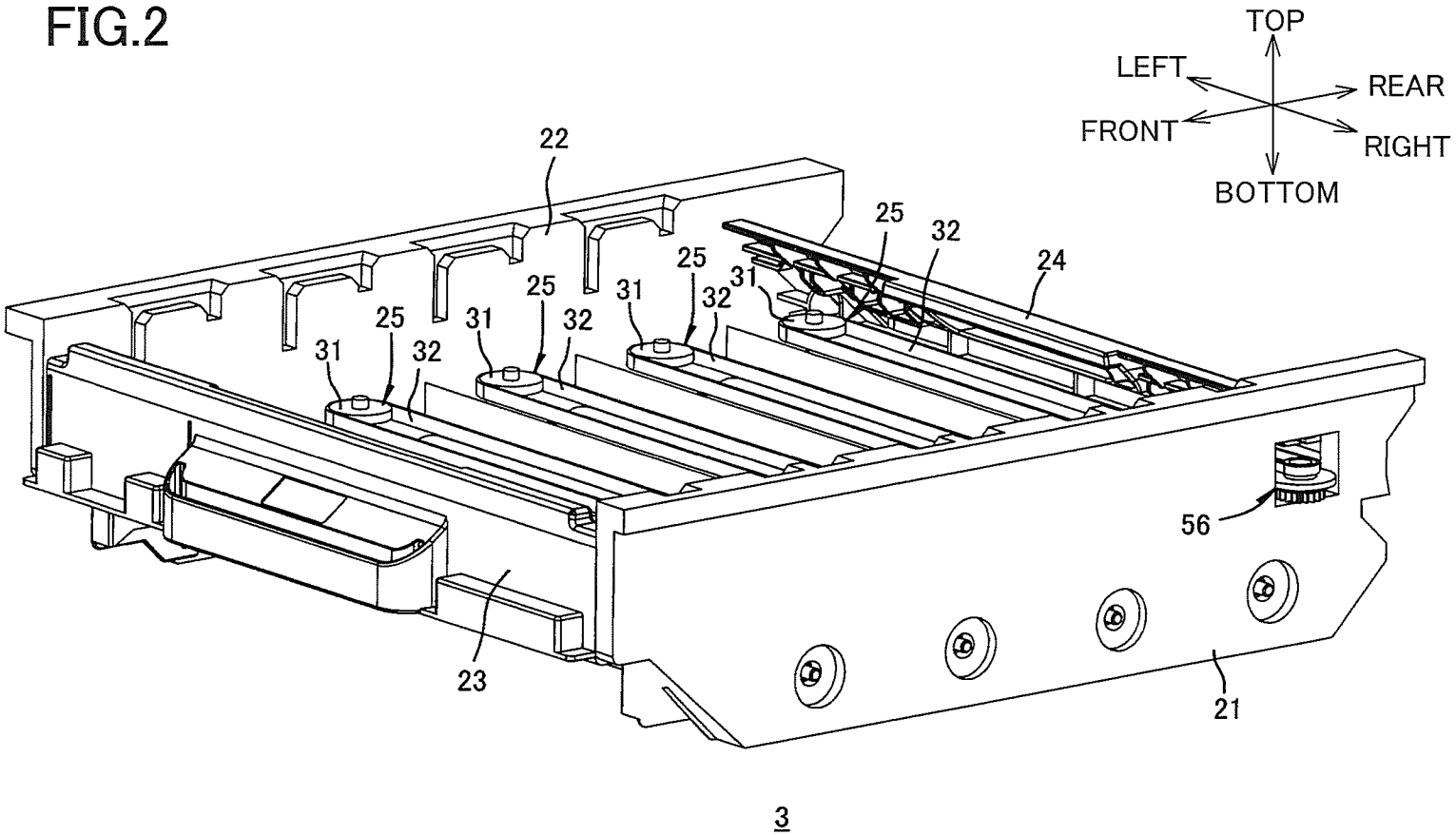
FIG. 2 is a perspective view of a drum unit of the printer according to the embodiment, in which a pinion gear is disposed at a first position.
Figure 3:
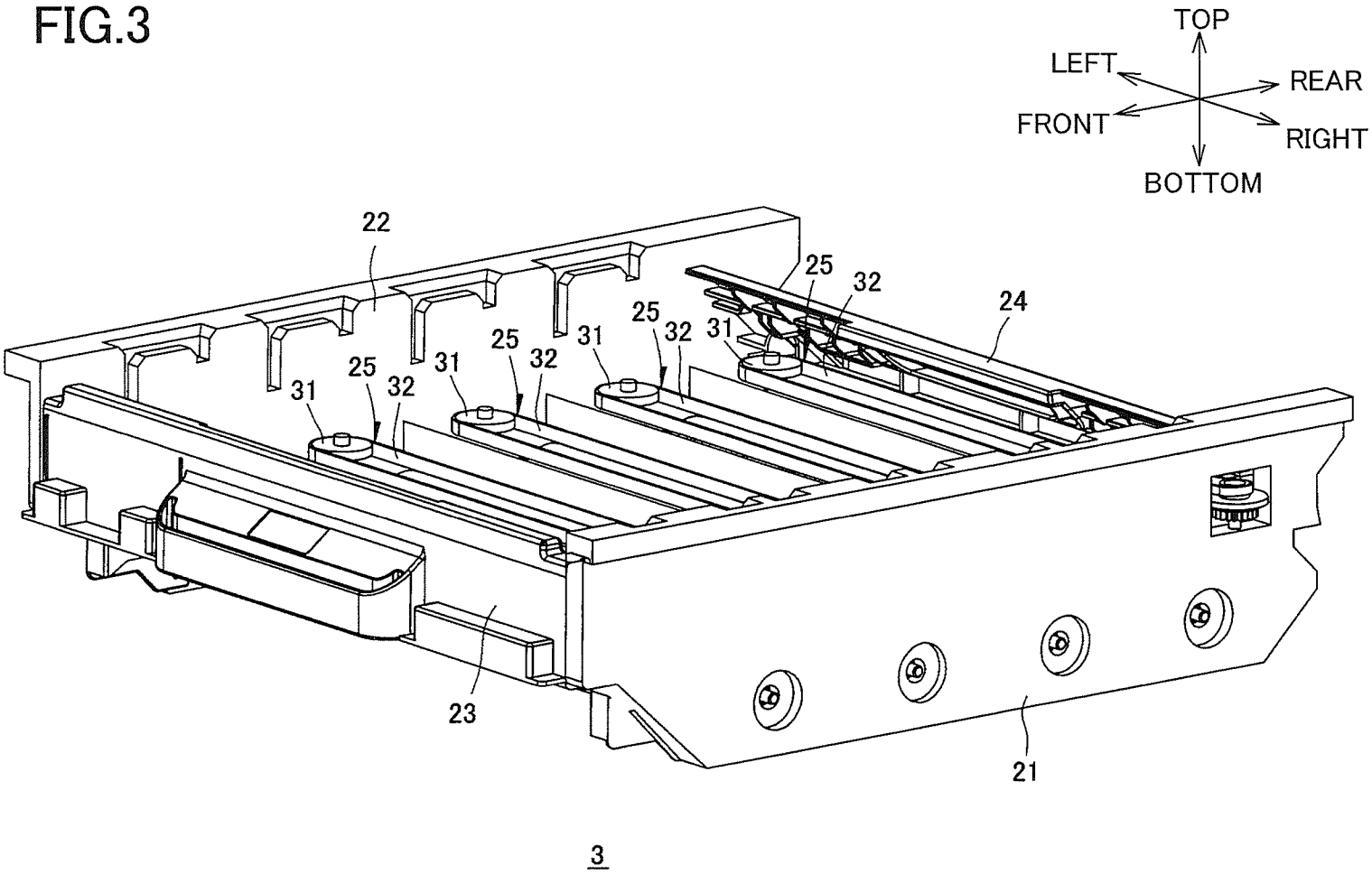
FIG. 3 is a perspective view of the drum unit, in which the pinion gear is disposed at a second position.

As shown in FIGS. 2 and 3, the drum unit 3 further includes a pair of side plates 21, 22 (a right side plate 21 and a left side plate 22), a front beam 23, and a rear beam 24. The right side plate 21 is arranged in confrontation with and spaced away from the left side plate 22 in the rightward/leftward direction. The front beam 23 bridges between the right side plate 21 and the left side plate 22 at a front portion thereof. The rear beam 24 bridges between the right side plate 21 and the left side plate 22 at a rear portion thereof.

The four photosensitive drums 5, the four chargers 6, and the four developing cartridges 7 (shown in FIG. 1) are collectively supported to the right side plate 21 and the left side plate 22. Further, in an outer frame (not shown) of each charger 6, a wire cleaner movement mechanism 25 is disposed between the right side plate 21 and the left side plate 22 and at upper and rearward positions in a space of the outer frame.

(1) Wire Cleaner Movement Mechanism

Figure 4A:
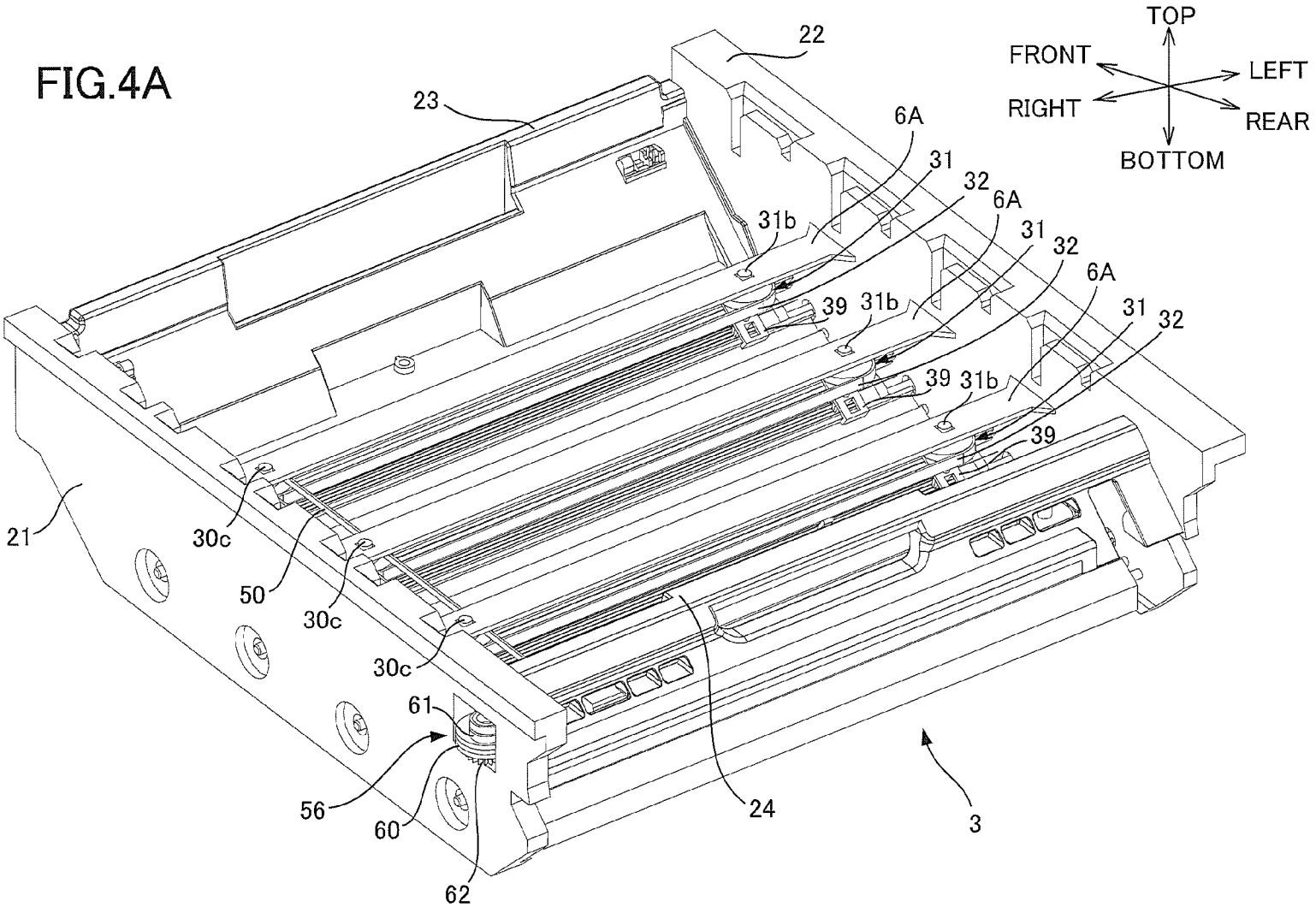
FIG. 4A is a perspective view of the drum unit in which each outer frame of each charger is omitted to particularly show a plurality of wire cleaner movement mechanisms and support plates suspending the same.
Figure 4B:
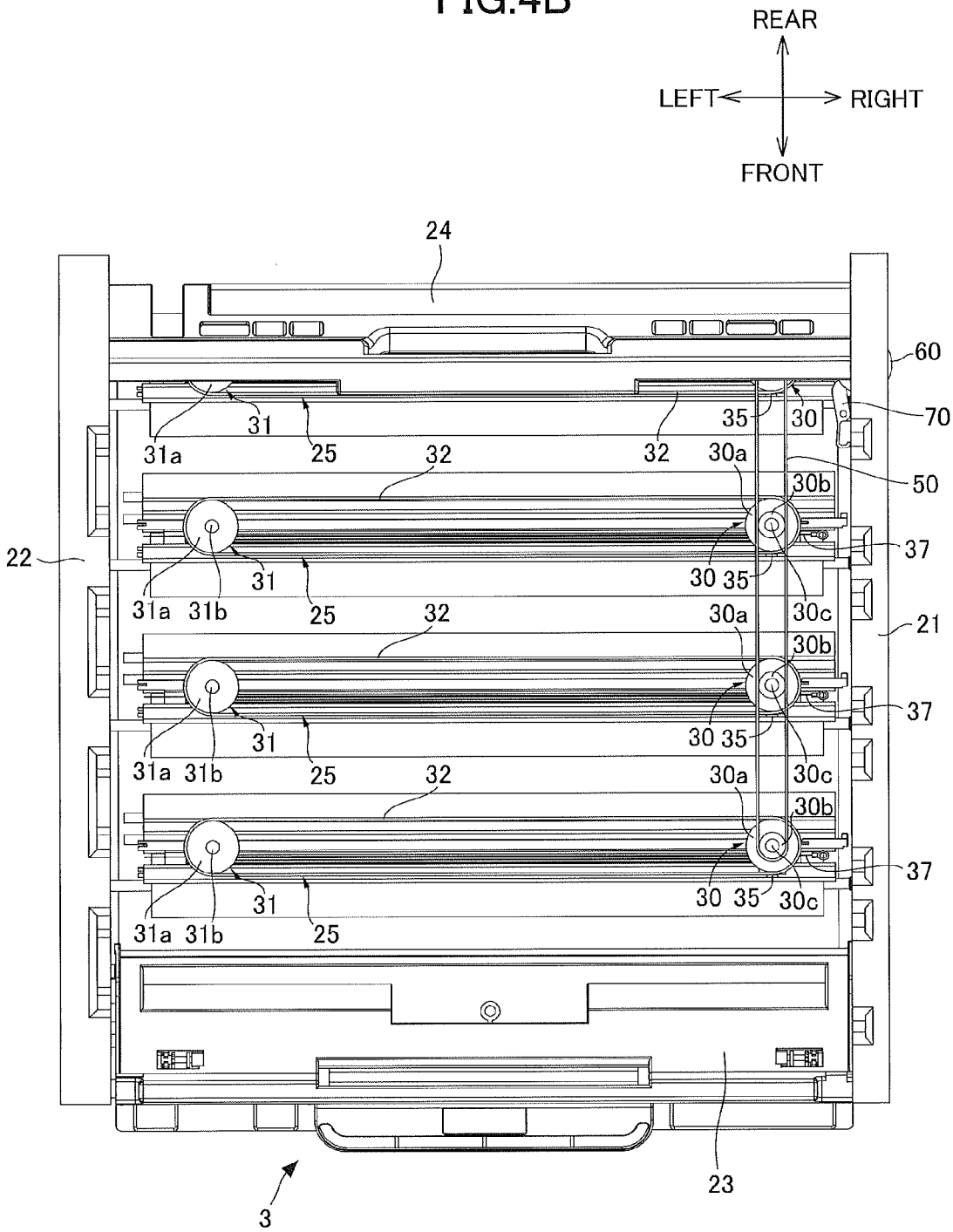
FIG. 4B is a plan view of the drum unit in which each outer frame of each charger and each support plate are omitted to particularly show the plurality of wire cleaner movement mechanisms and charging wires.
Figure 4C:
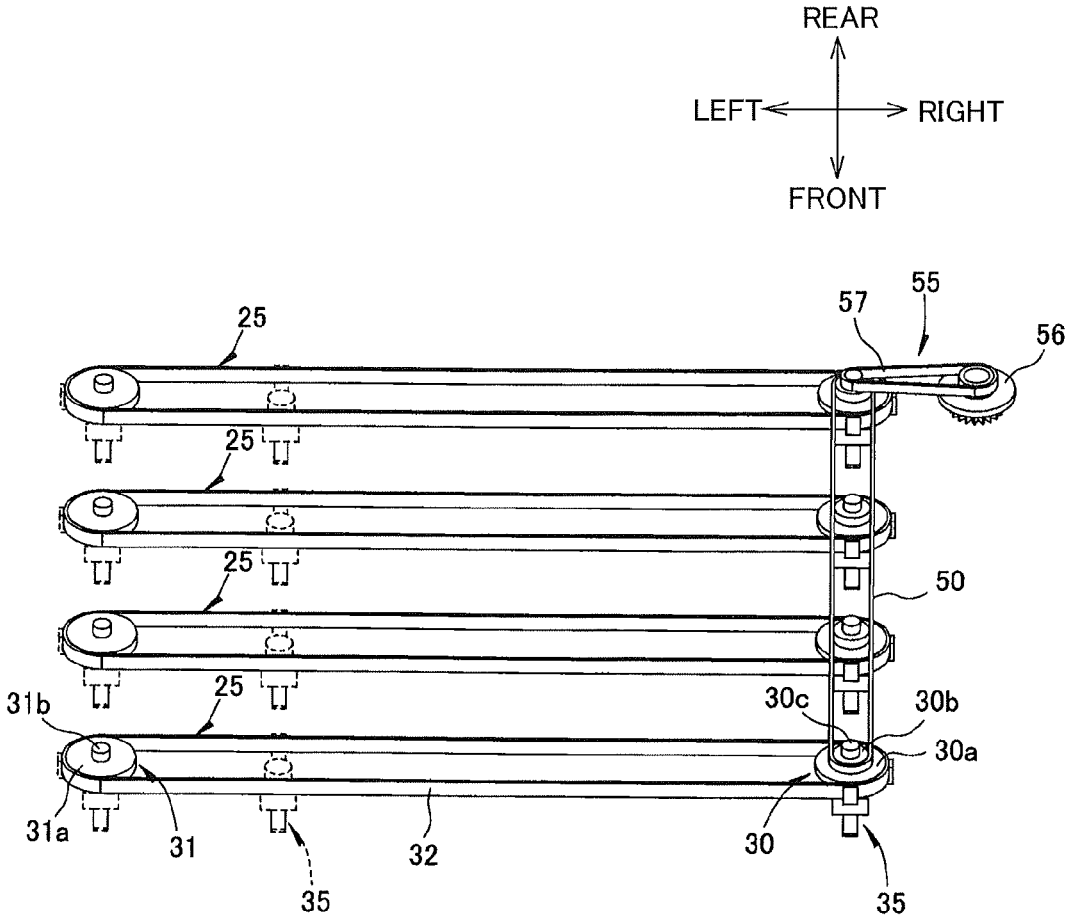
FIG. 4C is a perspective view of the plurality of wire cleaner movement mechanisms, a plurality of wire cleaners, a coupling belt, and a drive force transmission mechanism in the printer according to the embodiment.

As shown in FIG. 4A, in the outer frame (not shown) of each charge 6, a support plate 6A extends in leftward/rightward direction and is fixed to the outer frame. Alternatively, each support plate 6A can be positioned within the outer frame and is fixed to the side plates 21, 22. As shown in FIGS. 4A through 4C, each of the wire cleaner movement mechanisms 25 includes a drive pulley 30, a driven pulley 31, and an endless drive belt 32. In the present embodiment, four drive pulleys 30, four driven pulleys 31, and four endless drive belts 32 are provided.

The drive pulley 30 is disposed rightward of an image forming region of the corresponding photosensitive drum 5 in which the electrostatic latent image is formed. The drive pulley 30 includes a disk-shaped drive portion 30*a*, a disk-shaped coupling portion 30*b*, and a shaft portion 30*c*.

The coupling portion 30*b* is disposed above the drive portion 30*a*. The coupling portion 30*b* is arranged coaxially with the drive portion 30*a* and has a diameter smaller than that of the drive portion 30*a*. The shaft portion 30*c* extends vertically, and is arranged coaxially with the drive portion 30*a* and the coupling portion 30*b*. The shaft portion 30*c* has an upper end portion rotatably supported to the support plate 6A. The drive portion 30*a*, the coupling portion 30*b*, and the shaft portion 30*c* are integrally rotatable relative to the support plate 6A.

The driven pulley 31 is disposed leftward of the image forming region of the corresponding photosensitive drums 5. The driven pulley 31 includes a disk-shaped driven portion 31*a* and a shaft portion 31*b*. The driven portion 31*a* has an outer diameter substantially the same as that of the drive portion 30*a* of the drive pulley 30. The shaft portion 31*b* extends vertically, and is arranged coaxially with the driven portion 31*a* and is rotatable integrally therewith. The shaft portion 31*b* has an upper portion rotatably supported to the support plate 6A. In this way the wire cleaner movement mechanism 25 is rotatably supported to and suspended from the support plate 6A.

The drive belt 32 is an endless belt. The drive belt 32 is stretched around the drive portion 30*a* of the drive pulley 30 and the driven portion 31*a* of the driven pulley 31. When the drive pulley 30 rotates, the drive belt 32 circulates, thereby rotating the driven pulley 31. Incidentally, as shown in FIG. 4B, the charging wire 37 is not aligned with an imaginary line connecting between a rotation axis of the shaft portion 30*c* and a rotation axis of the shaft portion 31*b*, but is positioned slightly frontward of the imaginary line.

Each of the drive belts 32 has a wire cleaner 35. In the present embodiment, four wire cleaners 35 are provided in the four chargers 6, respectively.

(2) Wire Cleaner

Figure 5:
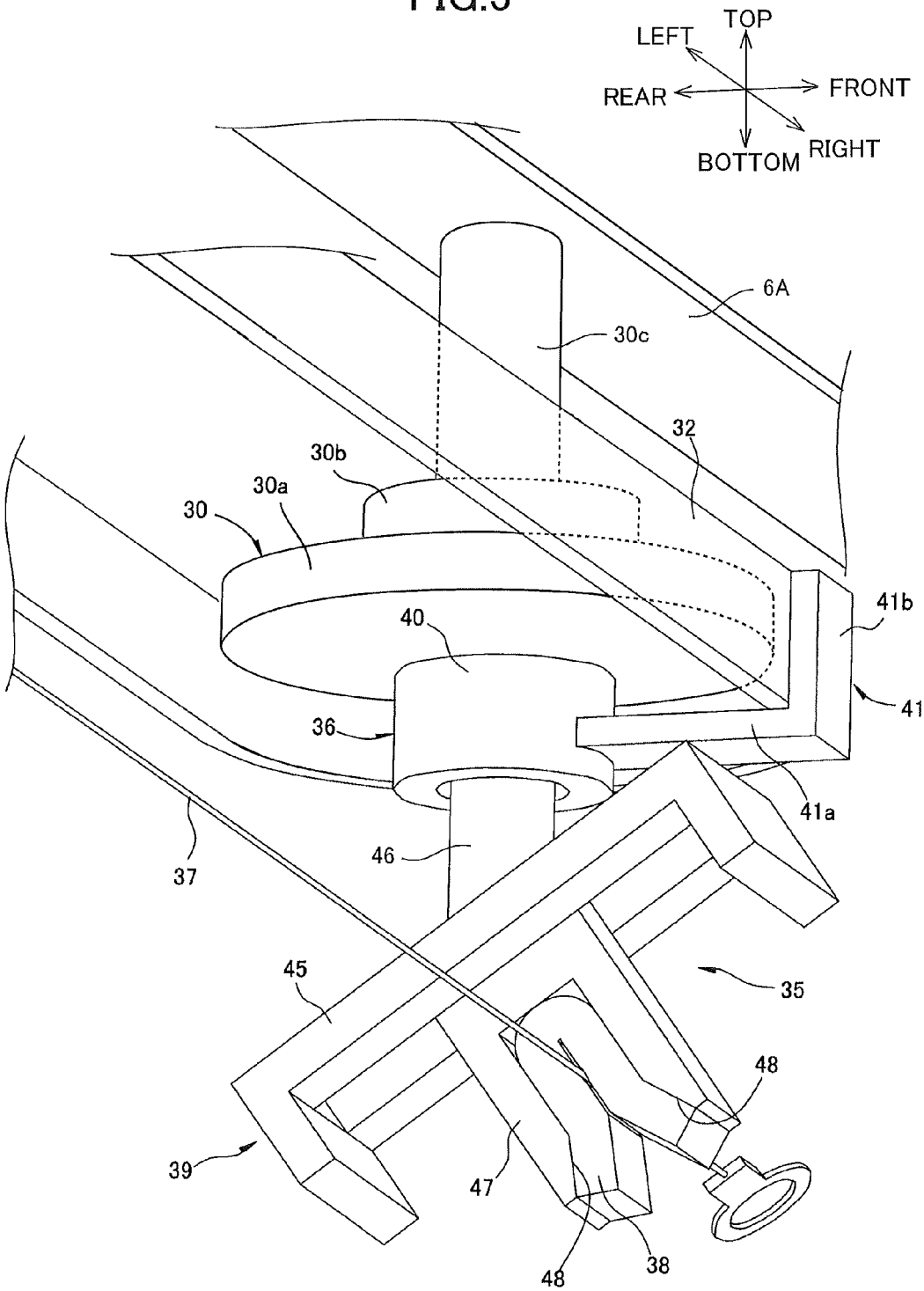
FIG. 5 is an enlarged perspective view of the wire cleaner shown in FIG. 4C.
Figure 6:
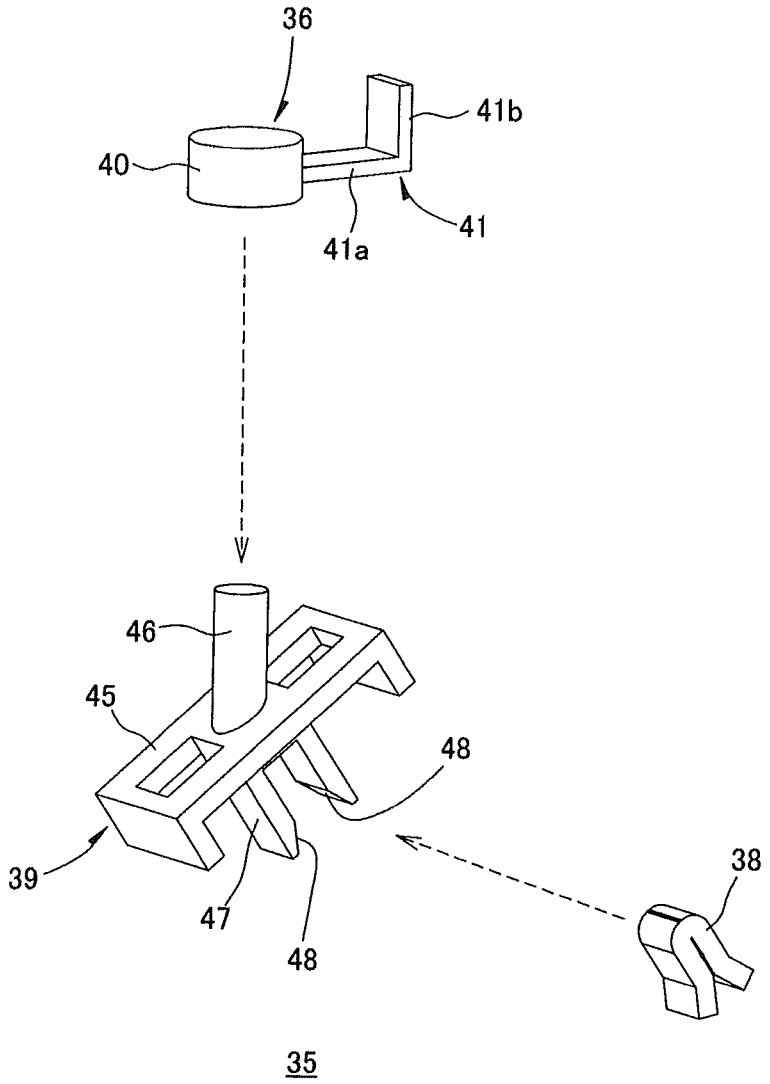
FIG. 6 is an exploded perspective view of the wire cleaner shown in FIG. 5.

As shown in FIGS. 5 and 6, each of the wire cleaners 35 includes a fixing member 36, a sponge 38, and a supporting member 39.

(2-1) Fixing Member

The fixing member 36 is fixed to and suspended from the drive belt 32. The fixing member 36 is integrally formed with a tubular portion 40 and an arm 41. The tubular portion 40 is a generally cylindrical shape having an upper closed end and a lower open end. The tubular portion 40 is positioned opposite to the coupling portion 30*b* with respect to the drive portion 30*a*.

The arm 41 is formed in an L-shape having a horizontal portion 41*a* and a vertical portion 41*b*. The horizontal portion 41*a* horizontally extends radially outward from an outer circumferential surface of the tubular portion 40. The vertical portion 41*b* extends upward from a radially outer end portion of the horizontal portion 41*a*, and is fixed to the drive belt 32.

A distance from an axis of the tubular portion 40 to the radially outer end portion of the horizontal portion 41*a* is substantially the same as a shortest distance from an axis of the shaft portion 30*c* to an outer circumferential surface of the drive belt 32. Further, the vertical portion 41*b* has a length substantially the same as a vertical width of the drive belt 32.

(2-2) Supporting Member

The supporting member 39 allows the sponge 38 to be supported by the fixing member 36. The supporting member 39 integrally includes a frame 45, an inserting portion 46, and a pinching portion 47.

The frame 45 is formed in a generally U-shape having a base portion and a pair of arm portion. The base portion is formed in a plate-shape and extends in frontward/rearward direction. The pair of arm portions extend diagonally downward from longitudinal ends of the base portion at a substantially right angle.

The base portion of the frame 45 has a surface from which the inserting portion 46 extends upwardly. The inserting portion 46 is formed in a cylindrical shape. An angle defined between the frame 45 and the inserting portion 46 is approximately 45 degrees. That is, the inserting portion 46 vertically extends while the frame 45 is inclined at 45 degrees relative to the inserting portion 46. The inserting portion 46 is inserted into the lower open end of the tubular portion 40, so that the inserting portion 46 is rotatable about its axis with respect to the tubular portion 40.

The pinching portion 47 is formed in a generally U-shape having a base portion and a pair of arm portions. The base portion of the pinching portion 47 has a longitudinal length smaller than that of the base portion of the frame 45. Each arm portion of the pinching portion 47 has a tip end formed with a tapered surface 48. Each of the tapered surfaces 48 has configuration such that a distance defined between the tapered surfaces 48 is gradually increased toward the tip ends of the free end portions.

The sponge 38 is adapted to clean the charging wire 37. The sponge 38 is folded into a substantially U-shape, and inserted into the pinching portion 47 maintaining the U-shaped folded state. The U-shaped sponge 38 has free ends that extend along the tapered surfaces 48. The charging wire 37 is interposed between inner folded surfaces of the sponge 38 inserted into the pinching portion 47.

(3) Coupling Belt

As shown in FIG. 4C, an endless coupling belt 50 is provided over the four wire cleaner movement mechanisms 25. More specifically, the coupling belt 50 is looped taut between the coupling portion 30*b* of the frontmost drive pulley 30 and the coupling portion 30*b* of the rearmost drive pulley 30 while being in rolling contact with the coupling portions 30*b* of the middle two drive pulleys 30.

When a drive force is inputted into one of the four drive pulleys 30, the corresponding drive portion 30*a* is driven to rotate. In association with rotation of the drive portion 30*a*, the corresponding coupling portion 30*b* starts to rotate. In association with rotation of the coupling portion 30*b*, the coupling belt 50 starts to circulate, thereby inputting the drive force into remaining three of the drive pulleys 30. Accordingly, the coupling belt 50 enables the four wire cleaner movement mechanisms 25 to be driven in synchronism with one another.

(4) Drive Force Transmission Mechanism

As shown in FIG. 4C, the rearmost wire cleaner movement mechanism 25 is connected to a drive force transmission mechanism 55. The drive force transmission mechanism 55 includes a pinion gear unit 56 and a drive force transmission belt 57.

(4-1) Pinion Gear Unit

Figure 7A:
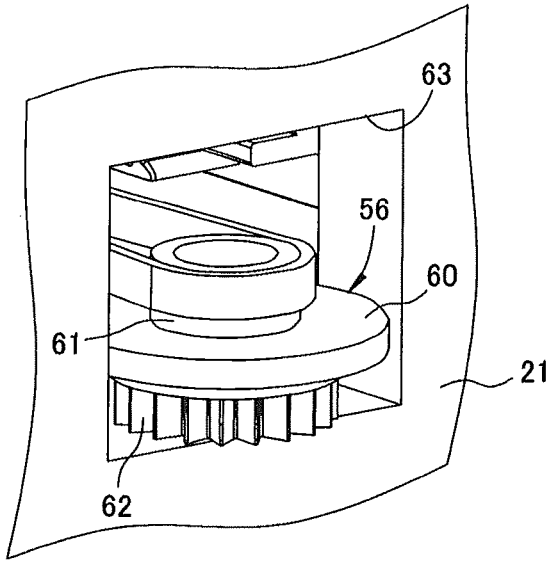
FIG. 7A is an enlarged perspective view of the pinion gear shown in FIG. 2.
Figure 7B:
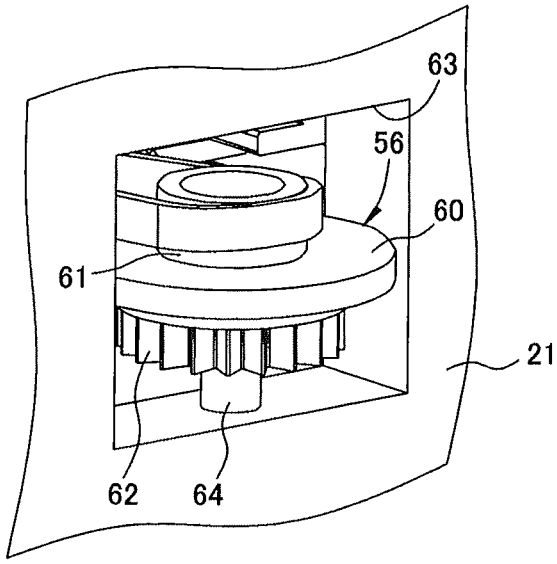
FIG. 7B is an enlarged perspective view of the pinion gear shown in FIG. 3.

The pinion gear unit 56 is disposed at a right rear end of the drum unit 3. As shown in FIGS. 7A and 7B, the pinion gear unit 56 is integrally provided with a flange portion 60, a pulley portion 61, and a gear portion (pinion gear) 62.

The flange portion 60 is formed in a disk shape. The flange portion 60 has an upper surface and a lower surface in an axial direction thereof, and an outer circumferential surface. The pulley portion 61 has a disk shape having a diameter smaller than that of the flange portion 60. The pulley portion 61 is fixed to the upper surface of the flange portion 60. The gear portion 62 has a disk shape having a diameter smaller than that of the flange portion 60. The gear portion 62 is fixed to the lower surface of the flange portion 60. That is, the gear portion 62 is positioned opposite to the pulley portion 61 relative to the flange portion 60. The gear portion 62 has a circumferential surface with gear teeth. The flange portion 60, the pulley portion 61 and the gear portion 62 are respectively formed with through holes (not shown) extending in the axial direction.

The right side plate 21 has a rear end portion formed with a rectangular-shaped hole 63 extending through a thickness thereof. The hole 63 defines a surface from which a support shaft 64 protrudes upward. The support shaft 64 is inserted into the thorough holes formed in the flange portion 60, the pulley portion 61, and the gear portion 62 (the pinion gear unit 56). Hence, the pinion gear unit 56 is rotatably supported to the right side plate 21.

While supported by the support shaft 64, the pinion gear unit 56 is vertically movable relative to the support shaft 64. That is, the pinion gear unit 56 is movable between a first position shown in FIG. 7A and a second position shown in FIG. 7B. In the first position, the gear portion 62 is in contact with the right side plate 21 (the surface defined by the hole 63). In the second position, the gear portion 62 is positioned upward of and spaced apart from the right side plate 21 (the surface defined by the hole 63). In a state such that the pinion gear unit 56 is supported by the support shaft 64, the outer circumferential surface of the flange portion 60 protrudes outward from an outer surface of the right side plate 21.

(4-2) Drive Force Transmission Belt

As shown in FIG. 4C, the drive force transmission belt 57 is an endless belt. The drive force transmission belt 57 is looped around and taut the pulley portion 61 of the pinion gear unit 56 and the shaft portion 30*c* of the rearmost drive pulley 30. When a drive force is inputted into the pinion gear unit 56, the pinion gear unit 56 starts to rotate. In association with rotation of the pinion gear unit 56, the drive force transmission belt 57 starts to circulate, thereby rotating the rearmost drive pulley 30 via the shaft portion 30*c*.

(5) Regulating Unit

Figure 8:
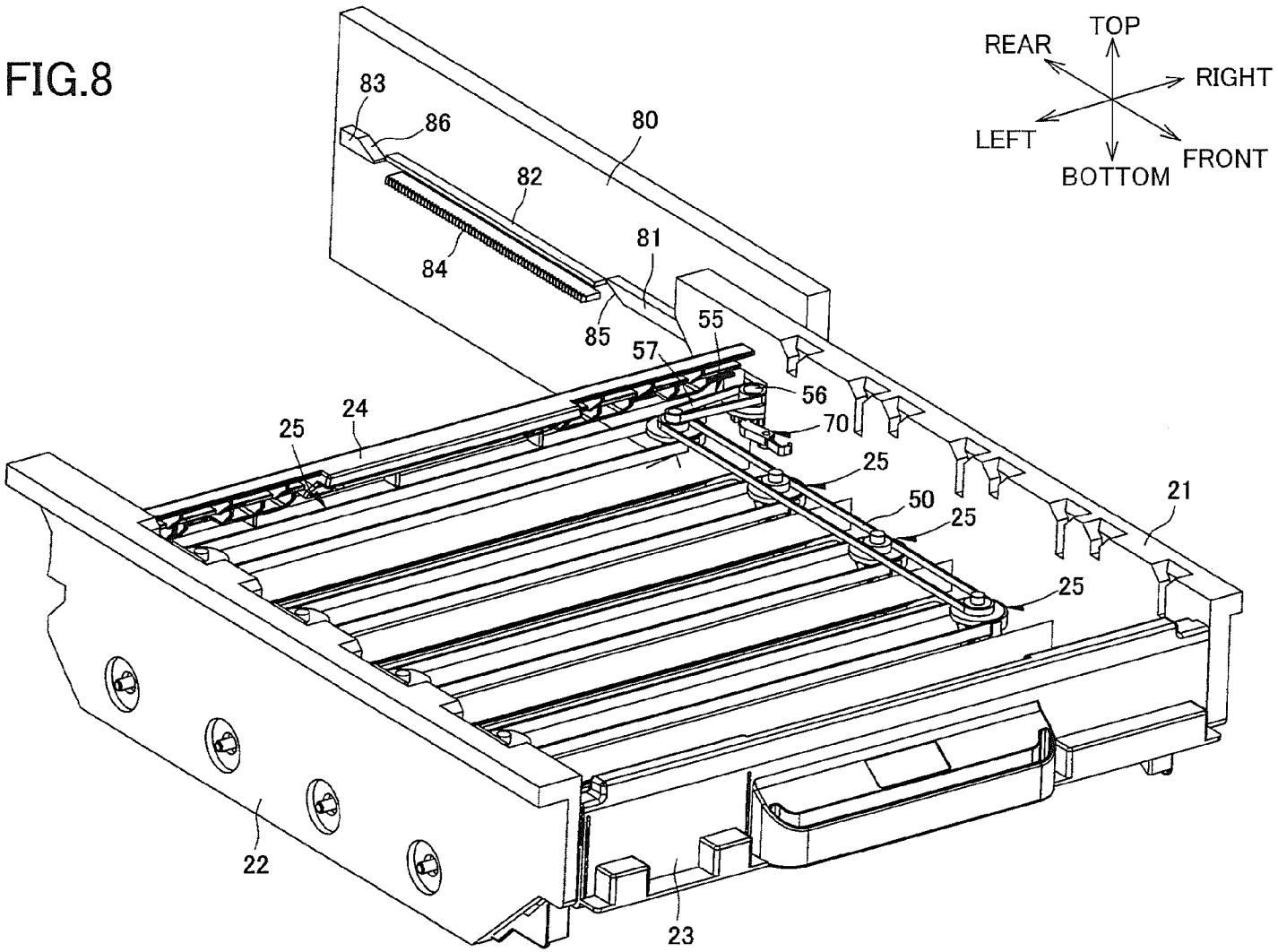
FIG. 8 is a perspective view showing a state in which the drum unit shown in FIG. 1 is disposed at a pulled-out position.
Figure 9:
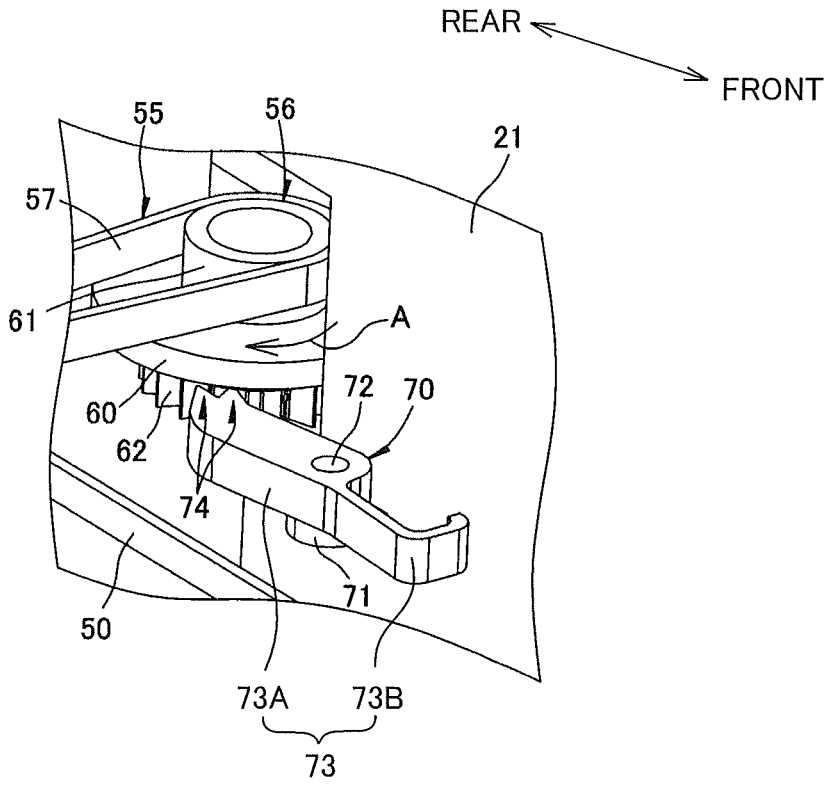
FIG. 9 is an enlarged perspective view of a regulation member shown in FIG. 8.

As shown in FIG. 8, the drum unit 3 includes a regulating unit 70 for regulating reverse rotation of the pinion gear unit 56. As shown in FIG. 9, the regulating unit 70 includes a supporting portion 71, a support shaft 72, and a main portion 73. The supporting portion 71 is formed in a plate shape. The supporting portion 71 is disposed in front of the hole 63 and extends inward from an inner surface of the right side plate 21. The support shaft 72 protrudes upward from an end portion of the supporting portion 71. The main portion 73 is pivotally movable about the support shaft 72.

The main portion 73 is formed in a bar shape and extends in the frontward/rearward direction. The main portion 73 has a rear end portion 73A provided with an engaging portion 74 meshedly engagable with the gear portion 62 of the pinion gear unit 56 supported to the right side plate 21. The main portion 73 has a front end portion 73B whose tip end is in contact with the inner surface of the right side plate 21. The front end portion 73B can position the rear end portion 73A of the main portion 73 to engage with the gear portion 62, but is resiliently deformable so as to allow the rear end portion 73A of the main portion 73 to disengage from the gear portion 62 while the free end of the front end portion 73B maintains contact with the inner surface of the right side plate 21.

When a force in a forward direction (a direction indicated by an arrow A shown in FIG. 9) is applied to the pinion gear unit 56, a force in a direction such that the rear end portion 73A of the main portion 73 is separated from the right side plate 21 is applied to the engaging portion 74 by the gear teeth of the gear portion 62. As a result, the main portion 73 is pivotally moved, so that the engaging portion 74 is disengaged from the gear portion 62. Accordingly, the gear portion 62 (the pinion gear unit 56) can be rotated in the direction indicated by the arrow A.

On the other hand, when a force in a reverse direction (a direction opposite to the direction indicated by the arrow A) is applied to the pinion gear unit 56, a force in a direction such that the rear end portion 73A of the main portion 73 approaches the right side plate 21 is applied to the engaging portion 74 by the gear teeth of the gear portion 62. As a result, the engaging portion 74 is tightly meshedly engaged with the gear portion 62. Accordingly, rotation of the gear portion 62 (the pinion gear unit 56) can be regulated.

3. Internal Structure of Main Casing

As shown in FIG. 8 and FIGS. 10A to 10F, the main casing 2 has a right side plate 80. The right side plate 80 has an inner surface from which a first switch portion 81, a rail portion 82, a second switch portion 83, and a rack gear 84 protrude inward.

The first switch portion 81 is formed in a plate shape extending rearward from a front end portion of the right side plate 80. For example, the first switch portion 81 has a length of two-fifths on a length of the right side plate 80 in the frontward/rearward direction. The first switch portion 81 has a rear end portion formed with a first slant surface 85. The first slant surface 85 extends diagonally downward and frontward from a distal rear end of the first switch portion 81.

The rail portion 82 is formed in a plate shape and extends in the frontward/rearward direction. The rail portion 82 is disposed rearward of the first switch portion 81. The rail portion 82 has a front end portion positioned slightly spaced apart from the rear end of the first switch portion 81. The rail portion 82 has a length of two-fifths on the length of the right side plate 80 in the frontward/rearward direction. The rail portion 82 has a vertical length (thickness) smaller than that of the first switch portion 81. The rail portion 82 has a lower surface in flush with a lower surface of the first switch portion 81. The front end face of rail portion 82 confronts the first slant surface 85.

The second switch portion 83 is formed in a plate shape and extends in the frontward/rearward direction. The second switch portion 83 is disposed rearward of the rail portion 82. The second switch portion 83 has a front end portion positioned slightly spaced apart from the rear end portion of the rail portion 82. The rear end portion of the second switch portion 83 is slightly spaced apart from the rear end portion of the right side plate 80. The second switch portion 83 has a vertical length (thickness) the same as that of the first switch portion 81. Further, the front end portion of the second switch portion 83 is formed with a second slant surface 86. The second slant surface 86 extends diagonally upward and rearward from a distal front end of the second switch portion 83. The second switch portion 83 has an upper surface in substantially flush with the upper surface of the rail portion 82. The rear end face of the rail portion 82 confronts the second slant surface 86.

The rack gear 84 is formed in a plate shape extending in the frontward/rearward direction. The rack gear 84 is disposed below the rail portion 82 and spaced apart from the rail portion 82. The rack gear 84 has a length slightly smaller than that of the rail portion 82 in the frontward/rearward direction. A vertical distance between the rack gear 84 and the rail portion 82 is substantially the same as a vertical distance between the upper surface of the flange portion 60 and an upper end face of the gear portion 62. The rack gear 84 has an inner surface formed with gear teeth meshedly engageable with the gear teeth of the gear portion 62.

The rack gear 84 has a length equivalent to one circular motion of the drive belt 32 when the pinion gear unit 56 is moved from a front end portion to a rear end portion of the rack gear 84. The length of the first switch portion 81 is not limited to two-fifths on the length of the right side plate 80. Further, the length of the rail portion 82 is not limited to two-fifths on the length of the right side plate 80. The length of the first switch portion 81 and the length of the rail portion 82 can be appropriately changed depending on the length of the rack gear 84.

4. Cleaning Operation

A cleaning operation will next be described while referring to FIGS. 10A to 10F.

Before the drum unit 3 is moved to the pulled-out position from the accommodating position, each wire cleaner 35 (shown in FIG. 4C) is disposed rightward of the image forming region of the corresponding photosensitive drum 5 (shown in FIG. 1). This position of the wire cleaner 35 will be referred to as an original position.

Figure 10A:
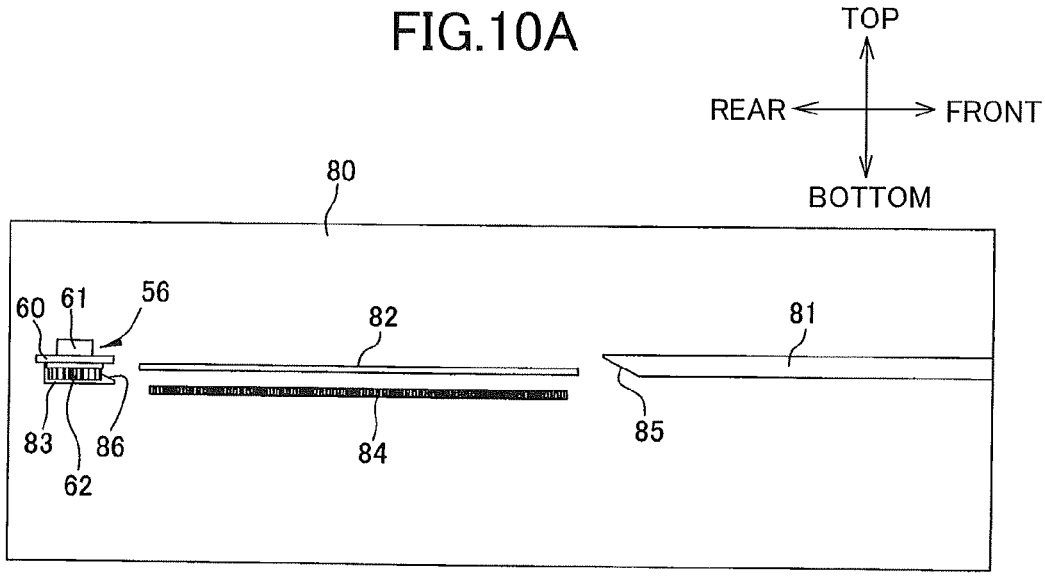
FIG. 10A is a view for description of a movement of the pinion gear for cleaning operation in the printer according to the embodiment.

In a state such that the drum unit 3 is at the accommodating position at which the drum unit 3 is accommodated in the main casing 2 (shown in FIG. 1), as shown in FIG. 10A, the lower surface of the flange portion 60 is mounted on the upper surface of the second switch portion 83. In this state, the pinion gear unit 56 is at the second position at which the gear portion 62 is positioned upward of and spaced apart from the lower surface of the hole 63 in the right side plate 21 as shown in FIG. 7B.

Figure 10B:
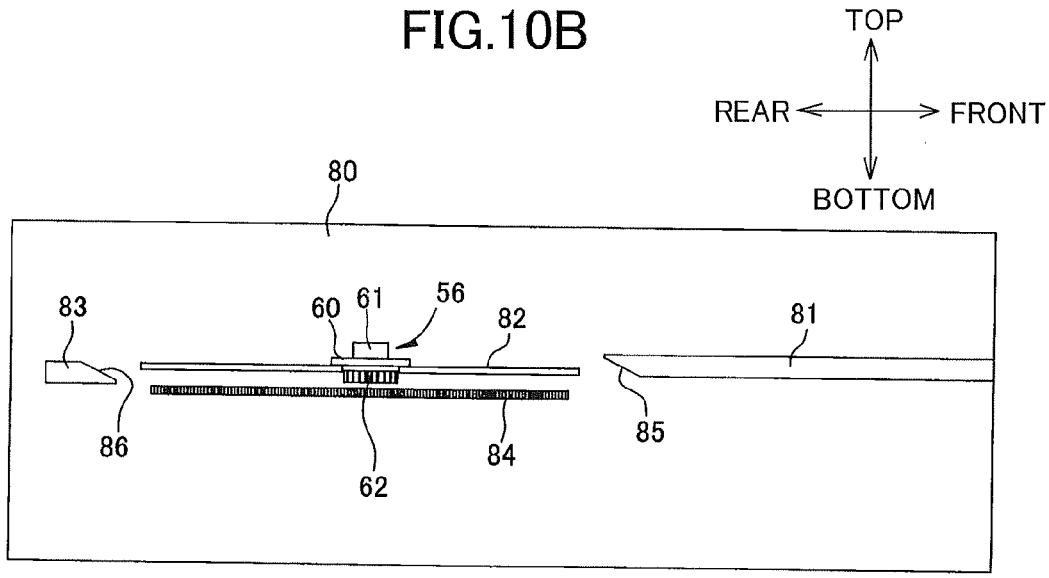
FIG. 10B is a view showing a state of the pinion gear subsequent to the state shown in FIG. 10A.

Then, when the drum unit 3 is moved frontward, as shown in FIG. 10B, the pinion gear unit 56 is moved frontward in association with movement of the drum unit 3, and the flange portion 60 is moved to the upper surface of the rail portion 82 from the upper surface of the second switch portion 83. Then, the flange portion 60 is slidingly moved frontward on the upper surface of the rail portion 82. At this time, the gear portion 62 of the pinion gear unit 56 is moved frontward at a position upward of and spaced apart from the rack gear 84. A path that the pinion gear unit 56 has been moved at this time will be referred to as a second path.

When the pinion gear unit 56 is moved frontward, the force in the reverse direction (the direction opposite to the direction indicated by the arrow A shown in FIG. 9) is applied to the flange portion 60 by a frictional force generated by the rail portion 82 and the flange portion 60. However, the regulating unit 70 provided in the right side plate 21 regulates the pinion gear unit 56 from rotating in the reverse direction. Therefore, reverse rotation of the pinion gear unit 56 does not occur.

Figure 10C:
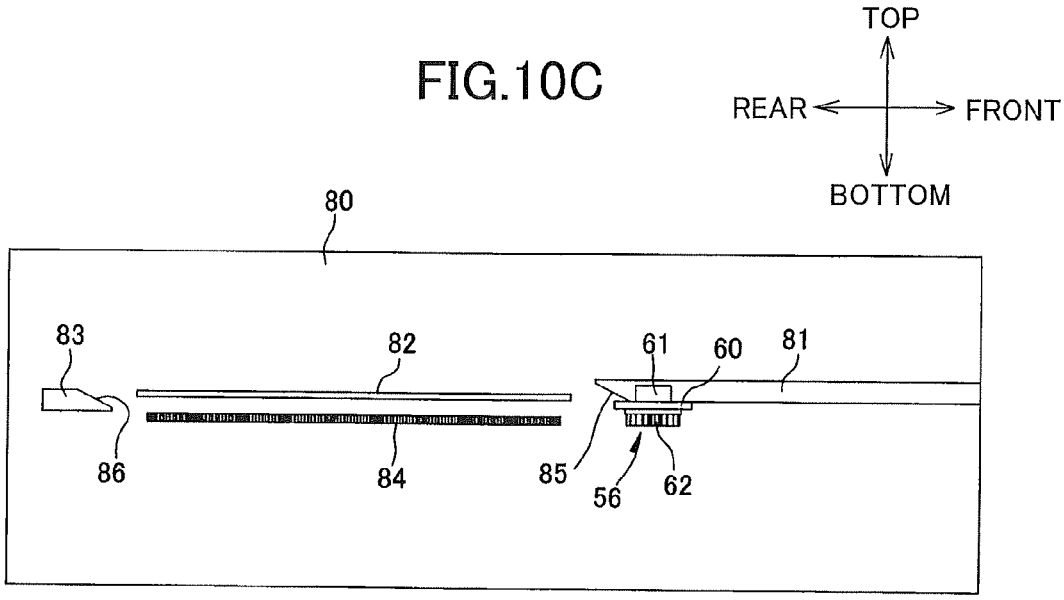
FIG. 10C is a view showing a state of the pinion gear subsequent to the state shown in FIG. 10B.

Subsequently, the flange portion 60 is brought into contact with the first slant surface 85 from the rear. When the drum unit 3 is further moved frontward, the flange portion 60 is guided by the first slant surface 85 so as to be moved diagonally downward and frontward. As a result, as shown in FIG. 10C, the upper surface of the flange portion 60 is brought into contact with the lower surface of the first switch portion 81 from the bottom. In this state, the pinion gear unit 56 is disposed at the first position at which the gear portion 62 is in contact with the lower surface of the hole 63 of the right side plate 21 as shown in FIG. 7A.

Figure 10D:
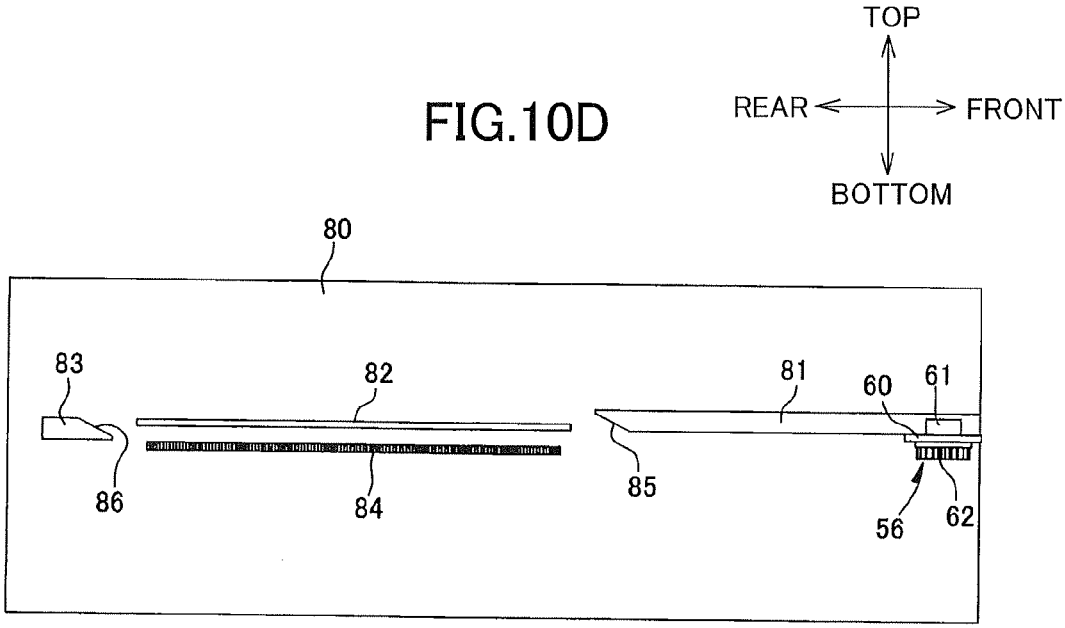
FIG. 10D is a view showing a state of the pinion gear subsequent to the state shown in FIG. 10C.

Next, the drum unit 3 is further moved frontward. As shown in FIG. 10D, when the pinion gear unit 56 is moved to a position confronting the front end portion of the right side plate 80, further frontward movement of the drum unit 3 is prevented by a stop member (not shown). Then, the drum unit 3 is disposed at the pulled-out position (shown in FIG. 8).

After the developing cartridge 7 is replaced with a new one, for example while the drum unit 3 is at the pulled-out position, the drum unit 3 is moved toward the accommodating position.

During the rearward movement of the pinion gear unit 56, the pinion gear unit 56 is maintained at the first position (shown in FIG. 7A) because the upper surface of the flange portion 60 is in contact with the lower surface of the first switch portion 81.

Figure 10E:
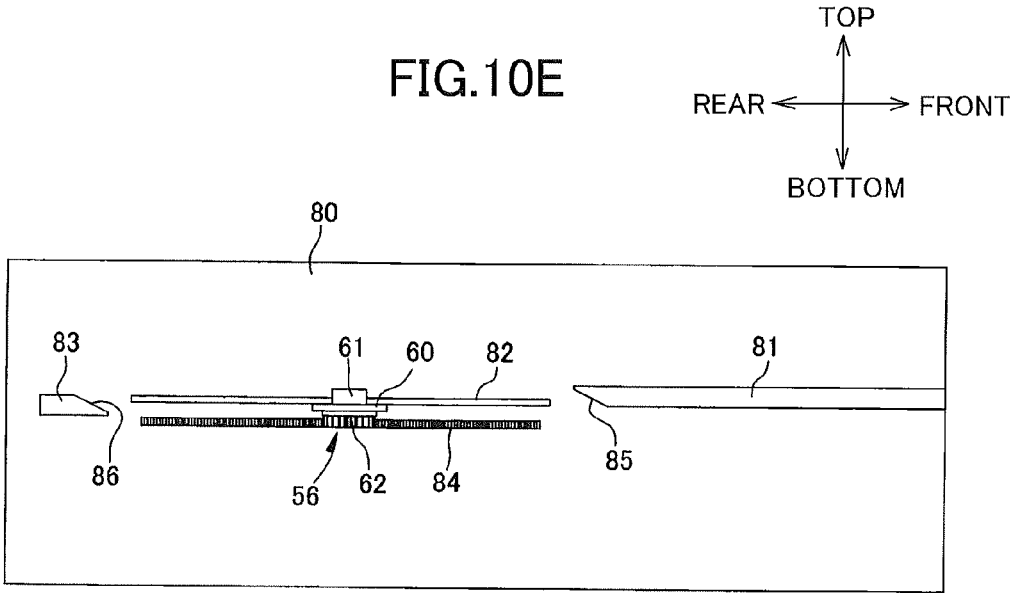
FIG. 10E is a view showing a state of the pinion gear subsequent to the state shown in FIG. 10D.

Then, when the drum unit 3 is further moved rearward, as shown in FIG. 10E, the pinion gear unit 56 is moved rearward in association with movement of the drum unit 3. The flange portion 60 is moved from the lower surface of the first switch portion 81 to the lower surface of the rail portion 82. Then, the flange portion 60 is slidingly moved rearward on the lower surface of the rail portion 82. At this time, the gear portion 62 of the pinion gear unit 56 is brought into meshing engagement with the rack gear 84.

In association with rearward movement of the drum unit 3, the pinion gear unit 56 rotates in the forward direction (the direction indicated by the arrow A shown in FIG. 9). As a result, as shown in FIG. 4C, the drive pulley 30 of the rearmost wire cleaner movement mechanism 25 is rotated via the drive force transmission belt 57. In association with rotation of the drive pulley 30, the drive belt 32 starts to circulate.

When the drive belt 32 circulates, the charging wire 37 (shown in FIG. 5) is cleaned from the right to the left while the wire cleaner 35 fixed to the drive belt 32 is moved leftward.

When the drum unit 3 is moved rearward, and the pinion gear unit 56 reaches the middle of the rack gear 84 in the frontward/rearward direction, the wire cleaner 35 moves across the image forming region, and approaches the driven pulley 31. The supporting member 39 of the wire cleaner 35 is rotationally movable relative to the fixing member 36 of the wire cleaner 35. Hence, when the fixing member 36 moves around the driven pulley 31, the supporting member 39 remains stationary.

Figure 10F:
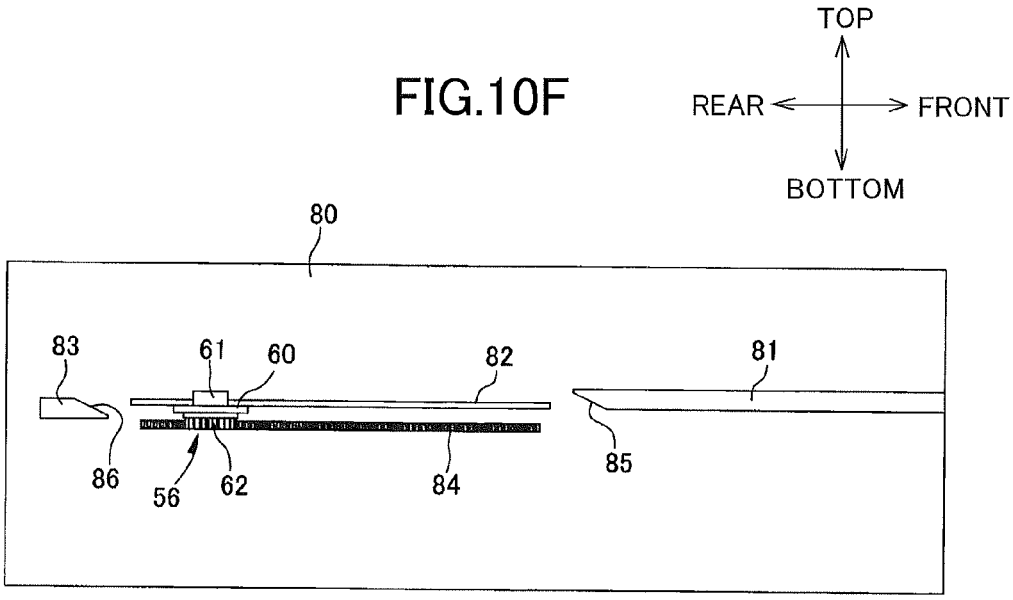
FIG. 10F is a view showing a state of the pinion gear subsequent to the state shown in FIG. 10E.

Then, as shown in FIG. 10F, the drum unit 3 is further moved rearward. The wire cleaner 35 again moves across the image forming region, and approaches the drive pulley 30. When the gear portion 62 of the pinion gear unit 56 is spaced apart from the rear end portion of the rack gear 84 so as to be disengaged from the rack gear 84, the wire cleaner 35 (shown in FIG. 4) is returned to the original position. Thus, the cleaning operation of the wire cleaner 35 is completed.

As described above, the charging wire 37 is not positioned in alignment with the imaginary line connecting between the rotation axis of the shaft portion 30*c* and the rotation axis of the shaft portion 31, but is positioned slightly ahead of the imaginary line (FIG. 4B). Therefore, the charging wire 37 does not cross an axis of the inserting portion 46. The pinching portion 47 pinching the charging wire 37 is inclined at 45 degrees with respect to the frontward/rearward direction because of the inclination of the frame 45 relative to the inserting portion 46. Therefore, when the tubular portion 40 is positioned coaxial with the drive pulley 30 or driven pulley 31, i.e., when the vertical portion 41*b* is moved along the outer periphery of the drive portion 30*a* or the driven portion 31*a*, a situation where the vertical portion 41*b* is positioned frontward of the drive portion 30*a* and the driven portion 31*a* provides a depth of the charging wire 37 into the sponge 38 of the pinching portion 47 greater than the depth in a situation where the vertical portion 41*b* is positioned rearward of the drive portion 30*a* and the driven portion 31*a*. In other words, in the present embodiment, even if the charging wire 37 is not aligned with the imaginary line, the pinching portion 47 can always pinch the charging wire 37 without imparting load to the charging wire 37, thereby enabling constant cleaning to the charging wire 37, because the depth of the charging wire 37 relative to the sponge 38 is changeable.

A path of the pinion gear unit 56 from where the gear portion 62 of the pinion gear unit 56 has been meshedly engaged from the rack gear 84 to where the gear portion 62 of the pinion gear unit 56 has been disengaged from the rack gear 84 will be referred to as a first path.

In the color printer 1, a diameter of the pinion gear unit 56 and the numbers of gear teeth is designed such that the drum unit 3 has a moving amount from the pulled-out position to the accommodating position greater than a moving amount of the wire cleaner 35. However, the moving amount of the drum unit 3 from the pulled-out position to the accommodating position can be smaller than the moving amount of the wire cleaner 35 by changing the diameter of the pinion gear unit 56 and/or the numbers of gear teeth, as long as the wire cleaner 35 is configured to move across at least the entire width of the image forming region when the drum unit 3 moves from the pulled-out position to the accommodating position.

When the drum unit 3 is further moved rearward, the flange portion 60 is brought into contact with the second slant surface 86 of the second switch portion 83 from the front. When the drum unit 3 is still further moved rearward, the flange portion 60 is guided by the second slant surface 86 so as to be moved diagonally upward and rearward. As a result, as shown in FIG. 10A, the lower surface of the flange portion 60 is brought into contact with the upper surface of the second switch portion 83 from the above. In this state, the pinion gear unit 56 is disposed at the second position, and further rearward movement of the drum unit 3 is restricted. Accordingly, the drum unit 3 is disposed at the accommodating position.

5. Operations and Effects (1) Operation and Effect 1

As described above, the drum unit 3 is movable between the accommodating position at which the drum unit 3 is accommodated in the main casing 2 and the pulled-out position at which the drum unit 3 is pulled outward of the main casing 2. The drum unit 3 includes the plurality of photosensitive drums 5 and the plurality of chargers 6. Each of the chargers 6 includes the charging wire 37 for charging the surface of the corresponding photosensitive drum 5 and the wire cleaner 35 for cleaning the charging wire 37. Each of the wire cleaners 35 is movable along the charging wire 37 while being in sliding contact with the charging wire 37.

Further, the drum unit 3 includes the plurality of the wire cleaner movement mechanisms 25 and the pinion gear unit 56. Within the main casing 2, the rack gear 84, the first switch portion 81, and the second switch portion 83 are provided. When the drum unit 3 is moved from the pulled-out position to the accommodating position, the pinion gear unit 56 is moved on the first path. In association with this movement, the pinion gear unit 56 receives the drive force from the rack gear 84. The drive force received by the pinion gear unit 56 is transmitted to the plurality of the wire cleaner movement mechanisms 25. With this configuration, each of the wire cleaners 35 is moved along the charging wire 37 while being in sliding contact with the charging wire 37. Hence, each of the charging wires 37 is cleaned by the wire cleaner 35. Accordingly, whenever the drum unit 3 is moved from the pulled-out position to the accommodating position, each of the charging wires 37 is cleaned. Therefore, it is not necessary for the user to manually move the wire cleaners 35, thereby saving time and effort of the user required to clean the charging wires 37.

When the drum unit 3 is moved to a position where the pinion gear unit 56 is moved past the rear end portion of the rack gear 84, the second switch portion 83 switches the position of the pinion gear unit 56 from the first path to the second path. Hence, when the drum unit 3 is moved from the accommodating position to the pulled-out position, the pinion gear unit 56 is moved on the second path. At this time, the pinion gear unit 56 does not receive the drive force from the rack gear 84, and each of the wire cleaners 35 remains stationary. When the drum unit 3 is moved to a position where the pinion gear unit 56 is moved past the front end portion of the rack gear 84, the first switch portion 81 switches the position of the pinion gear unit 56 from the second path to the first path. In case the drum unit 3 is moved toward the pulled-out position but not to the position where the pinion gear unit 56 is moved past the front end portion of the rack gear 84, and returned to the accommodating position, each of the wire cleaners 35 is not moved. Thus, each of the charging wires 37 is not cleaned by the wire cleaner 35. Consequently, non-uniform cleaning to the charging wires 37 can be prevented. Further, occurrence of non-uniform charge on the surfaces of the photosensitive drums 5 caused by the non-uniform cleaning can be prevented.

(2) Operation and Effect 2

The rail portion 82 is disposed above the rack gear 84. The rail portion 82 is spaced apart from the rack gear 84 and extends parallel to the rack gear 84 in the frontward/rearward direction. The rail portion 82 guides the movement of the pinion gear unit 56 on the second path. Accordingly, reliable movement of the pinion gear unit 56 can be achieved.

(3) Operation and Effect 3

The rack gear 84 has a length such that the drive belt 32 makes one circular movement while the pinion gear unit 56 is moved from the front end portion of the rack gear 84 to the rear end portion thereof, that is, a length such that the pinion gear unit 56 is being meshedly engaged with the rack gear 84 while the wire cleaner 35 makes one back-and-forth movement in the portion of the charging wire 37 confronting the image forming region. Hence, the wire cleaner 35 reliably entirely cleans the portion of the charging wire 37 confronting the image forming region.

(4) Operation and Effect 4

When the drum unit 3 reaches a complete pulled-out position, the pinion gear unit 56 is moved to the first position (shown in FIG. 7A) by the first switch portion 81. Accordingly, movement of the pinion gear unit 56 from the second position to the first position while the drum unit 3 is on its way to the complete pulled-out position can be reliably prevented.

Further, when the drum unit 3 reaches a complete accommodating position, the pinion gear unit 56 is moved to the second position (shown in FIG. 7B) by the second switch portion 83. Accordingly, movement of the pinion gear unit 56 from the first position to the second position before the drum unit 3 reaches the complete accommodating position can be reliably prevented.

(5) Operation and Effect 5

The rack gear 84 extends in the frontward/rearward direction (that is, in a direction such that the drum unit 3 is moved) between the accommodating position and the pulled-out position. Further, the drive force transmission mechanism 55 includes the pinion gear unit 56 meshedly engageable with and disengageable from the rack gear 84. With this configuration, when the drum unit 3 is moved to the accommodating position from the pulled-out position, the pinion gear unit 56 can be engaged with the rack gear 84, and when the drum unit 3 is moved to the pulled-out position from the accommodating position, the pinion gear unit 56 can be disengaged from the rack gear 84. Therefore, the drive force transmission mechanism 55 can be selectively switched between a transmitted state where the drive force is transmitted to the pinion gear unit 56 and a non-transmitted state where the drive force is not transmitted to the pinion gear unit 56.

(6) Operation and Effect 6

The pinion gear unit 56 is provided at a position so as to be accommodated within the main casing 2 when the drum unit 3 is at the pulled-out position. Therefore, when the drum unit 3 is moved to the pulled-out position, engagement of the pinion gear unit 56 with the rack gear 84 can be maintained.

(7) Operation and Effect 7

The drum unit 3 includes the right side plate 21 extending in the frontward/rearward direction. The pinion gear unit 56 is disposed at the rear end portion of the right side plate 21. Therefore, the right side plate 21 prevents the pinion gear unit 56 from being touched by the user when the user moves the drum unit 3 to the pulled-out position.

(8) Operation and Effect 8

The moving amount of the drum unit 3 from the pulled-out position to the accommodating position is greater than the moving amount of the wire cleaner 35 from when the wire cleaner 35 starts moving in association with movement of the drum unit 3 until the wire cleaner 35 has moved past the portion of the charging wire 37 confronting the image forming region. Therefore, while the drum unit 3 is moved from the pulled-out position to the accommodating position, the wire cleaner 35 reliably passes through the portion of the charging wire 37 confronting the image forming region. As a result, non-uniform cleaning to the charging wire 37 can be prevented.

(9) Operation and Effect 9

The rail portion 82 has a length greater than that of the rack gear 84. When the drum unit 3 is moved from the accommodating position to the pulled-out position, the pinion gear unit 56 cannot be moved to the first position from the second position unless the moving distance of the drum unit 3 is greater than the entire length of the rack gear 84. Accordingly, even if the drum unit 3 is moved from the accommodating position to the pulled-out position but placed at a position between the accommodating position and the pulled-out position, the charging wire 37 is not cleaned by the wire cleaner 35. Thus, non-uniform cleaning to the charging wire 37 can be successfully prevented.

(10) Operation and Effect 10

The drum unit 3 is moved in the frontward/rearward direction that is perpendicular to the leftward/rightward direction parallel to the extending direction of the charging wire 37. As a result, a distance between the accommodating position and the pulled-out position can become smaller than the entire length of the charging wire 37.

(11) Operation and Effect 11

The four wire cleaners 35 are provided in one-on-one correspondence with respect to the four photosensitive drums 5. The four wire cleaner movement mechanisms 25 are provided in one-on-one correspondence with respect to the four wire cleaners 35. The four wire cleaner movement mechanisms 25 are operated in interlocking relation to one another by the coupling belt 50. With this configuration, when the drive force is transmitted to one of the wire cleaner movement mechanisms 25 to move the corresponding wire cleaner 35, the drive force can be transmitted to remaining three wire cleaner movement mechanisms 25 via the coupling belt 50, thereby moving remaining three wire cleaners 35. Accordingly, all the four wire cleaners 35 can be moved simultaneously. Thus, a structure for transmitting the drive force to the plurality of the wire cleaner movement mechanisms 25 can be simplified in comparison with a case where a drive force is transmitted to each of the four wire cleaner movement mechanisms 25 corresponding to the four wire cleaners 35. Still however, each of the wire cleaners 35 may be provided with a pinion gear unit 56. If this is the case, the coupling belt 50 can be dispensed with.

Further, in a configuration such that the four developing cartridges 7 are provided in one-on-one correspondence with respect to the four photosensitive drums 5, for example, when the frontmost developing cartridge 7 is detached from the drum unit 3, the drum unit 3 may be only slightly pulled outward of the main casing 2 to remove the frontmost developing cartridge 7 from the drum unit 3. As described above, in this case, the cleaning operation of the charging wires 37 is not performed by the wire cleaners 35. Accordingly, in the tandem type color printer, occurrence of non-uniform cleaning to the charging wires 37 can be reliably prevented.

6. Modifications

Various modifications are conceivable.

In the above described embodiment, the image forming device is the tandem type color printer. However, a monochromatic printer is also available. If this is the case, the monochromatic printer has a main casing in which a drum cartridge including a charging wire and a photosensitive drum is detachably mounted. The drum cartridge includes a single wire cleaner movement mechanism 25. The coupling belt 50 is dispensed with.

The timing to switch the movement path of the pinion gear unit 56 to the second path from the first path (the timing to move the pinion gear unit 56 to a relatively higher position from a relatively lower position) can be a timing when the drum unit 3 starts to be moved from the accommodating position to the pulled-out position. Further, the timing to switch the movement path of the pinion gear unit 56 to the first path from the second path (the timing to move the pinion gear unit 56 to the relatively lower position from the relatively higher position) can be a timing when the drum unit 3 starts to be moved from the pulled-out position to the accommodating position.

Further, the direction such that the drum unit 3 is pulled out is not limited to the frontward/rearward direction, that is, the direction such that the photosensitive drums 5 are juxtaposed to each other. The drum unit 3 can be configured so as to be movable in a direction perpendicular to the juxtaposed direction of the photosensitive drums 5. In association with the movement of the drum unit 3, the cleaning operation of the charging wires 37 can be performed.

While the present invention has been described in detail with reference to the embodiment thereof, it would be apparent to those skilled in the art that various changes and modifications may be made therein without departing from the spirit of the invention.

What is claimed is:

1. An image forming device comprising:

a main casing;

a photosensitive member having an axis defining an axial direction and a surface including an image forming region on which an electrostatic latent image is formed, the image forming region having a width in the axial direction;

a charger comprising:

a charging wire extending in the axial direction and configured to charge the surface of the photosensitive member; and a wire cleaner movable along the charging wire while being in sliding contact with the charging wire;

an accommodating member configured to accommodate therein the photosensitive member and the charger and movable in a moving direction between an accommodating position where the accommodating member is accommodated in the main casing and a pulled-out position where the accommodating member is pulled outward of the main casing;

a moving section accommodated in the accommodating member and configured to move the wire cleaner;

a driving section extending in the main casing and configured to generate a drive force to move the moving section;

a transmitting section accommodated in the accommodating member and movable selectively to one of a first path on which the transmitting section is connected to the driving section and a second path on which the transmitting section is disconnected from the driving section, the transmitting section being configured to transmit the drive force from the driving section to the moving section when the transmitting section is moved on the first path;

a first switching section disposed at the main casing and located at a pulled-out position side relative to the driving section, the first switching section being configured to switch a position of the transmitting section from the second path to the first path;

a second switching section disposed at the main casing and located at an accommodating position side relative to the driving section, the second switching section being configured to switch a position of the transmitting section from the first path to the second path; and a rail section extending in the main casing parallel to an extending direction of the driving section and configured to guide movement of the transmitting section on the second path, the transmitting section being in direct contact with the rail section when the transmitting section is moved on the second path.

2. The image forming device as claimed in claim 1, wherein the transmitting section is movable between a first position in alignment with the first path and a second position in alignment with the second path.

3. The image forming device as claimed in claim 1, wherein the rail section has a length greater than a length of the driving section.

4. The image forming device as claimed in claim 1, wherein the charging wire has a confronting portion such that the width of the image forming region confronts, and wherein the driving section has a length so as to continuously provide the transmitting section with the drive force while the wire cleaner makes one back-and-forth movement in the confronting portion of the charging wire.

5. The image forming device as claimed in claim 1, wherein the first switching section is configured to switch the position of the transmitting section to the first path from the second path when the accommodating member has been completely pulled out to the pulled-out position, and wherein the second switching section is configured to switch the position of the transmitting section to the second path from the first path when the accommodating member has been completely moved to the accommodating position.

6. The image forming device as claimed in claim 1, wherein the driving section comprises a rack gear extending in the moving direction between the accommodating position and the pulled-out position, and wherein the transmitting section comprises a pinion gear meshedly engageable with the rack gear.

7. The image forming device as claimed in claim 6, wherein the pinion gear is provided at a position accommodated in the main casing when the accommodating member is located at the pulled-out position.

8. The image forming device as claimed in claim 6, further comprising a rail section extending in the main casing parallel to an extending direction of the driving section and configured to guide movement of the transmitting section on the second path; and wherein the transmitting section is movable between a first position in alignment with the first path and a second position in alignment with the second path, and the transmitting section further comprises a flange portion slidingly movable over the rail section during the movement of the accommodating member toward the pulled-out position to thus separate the pinion gear from the rack gear.

9. The image forming device as claimed in claim 8, wherein the rail section and the rack gear extend in parallel to each other with a space therebetween, the flange portion being positioned below the rail section during movement of the accommodating member from its complete pulled-out position to the accommodating position to thus engage the pinion gear with the rack gear.

10. The image forming device as claimed in claim 6, wherein the accommodating member includes a side plate extending in the moving direction, and wherein the pinion gear is provided at the side plate.

11. The image forming device as claimed in claim 1, wherein the charging wire has a confronting portion such that the width of the image forming region confronts, and wherein the accommodating member has a moving amount when moving from the pulled-out position to the accommodating position, the wire cleaner having a moving amount when passing through the confronting portion of the charging wire, the moving amount of the accommodating member being greater than the moving amount of the wire cleaner .

12. The image forming device as claimed in claim 1, wherein the moving direction of the accommodating member is perpendicular to the extending direction of the charging wire.

13. The image forming device as claimed in claim 1, wherein the photosensitive member includes a plurality of photosensitive bodies juxtaposed with each other in a predetermined direction relative to the accommodating member; and the image forming device further comprising a plurality of cartridges attachable to the accommodating member and provided in one-on-one correspondence with the plurality of photosensitive bodies.

14. The image forming device as claimed in claim 13, wherein the wire cleaner includes a plurality of cleaning elements each corresponding to each photosensitive body, and wherein the moving section includes a plurality of moving elements each corresponding to each photosensitive body; and, the image forming device further comprising an interlocking mechanism capable of operating the plurality of moving elements in interlocking relationship with one another by the drive force transmitted to the transmitting section from the driving section.

* * * * *